United States Patent [19]

Peters et al.

[11] Patent Number: 5,028,275

[45] Date of Patent: Jul. 2, 1991

[54] METHOD OF PRODUCING A LINER TO COVER AN EXPLOSIVE CHARGE

[75] Inventors: Jörg Peters, Düsseldorf; Herbert Weisshaupt, Aachen, both of Fed. Rep. of Germany

[73] Assignee: Rheinmetall GmbH, Dusseldorf, Fed. Rep. of Germany

[21] Appl. No.: 320,162

[22] Filed: Mar. 7, 1989

[30] Foreign Application Priority Data

Mar. 18, 1988 [DE] Fed. Rep. of Germany ..... 3809051

[51] Int. Cl.[5] ..... C21D 8/00

[52] U.S. Cl. ..... 148/2; 148/3; 148/320; 75/568

[58] Field of Search ..... 148/2, 3, 12 F, 320, 148/12 C; 75/58

[56] References Cited

FOREIGN PATENT DOCUMENTS

| | | | |
|---|---|---|---|
| 2913103 | 1/1980 | Fed. Rep. of Germany . | |
| 1057293 | 3/1954 | France . | |
| 671317 | 10/1965 | France . | |
| 50-2847 | 1/1975 | Japan | 148/320 |
| 59-118861 | 7/1984 | Japan | 148/2 |

*Primary Examiner*—Deborah Yee

*Attorney, Agent, or Firm*—Spencer & Frank

[57] ABSTRACT

A method of producing a low-carbon iron material to cover an explosive charge and the iron material produced by same wherein the molten raw iron material is refined to produce a dissolved carbon content in the iron material of less than 0.01 weight percent, the refined iron material is cast in a deoxidized state, and a homogeneous structure of the material is set by high temperature reshaping of the casting at a temperature greater than 880° C. to produce a material grain size of less than 100 μm.

19 Claims, 2 Drawing Sheets

Effect of Thermomechanical Treatment on the Microstructure of SSR-Steel

Effect of Thermomechanical Treatment on the Microstructure of SSR-Steel $T_U$ = Temperature of Hot Rolling

| $\varphi_n^n$ | $T_U$ = 1050° | $T_U$ = 1000° | $T_U$ = 950° | $T_U$ = 900° |
|---|---|---|---|---|
| n=2 $\varphi_n$=0.47 | 100 µm | 100 µm | 100 µm | 100 µm |
| n=4 $\varphi_n$=0.23 | 100 µm | 100 µm | 100 µm | 100 µm |
| n=6 $\varphi_n$=0.15 | 100 µm | 100 µm | 100 µm | 100 µm |

METHOD OF PRODUCING A LINER TO COVER AN EXPLOSIVE CHARGE

BACKGROUND OF THE INVENTION

The present invention relates to a method of producing a liner made of a low-carbon iron material to cover an explosive charge and allow carbon iron material formed by the method for such purpose.

Liners to cover explosive charges are generally composed of iron or copper. Copper is customarily employed for the liners of pointed cone shaped charges. The liner material should have high ductility and a high degree of purity to avoid the possible work hardening.

Many different materials have already been employed to produce liners to cover explosive charges.

Federal Republic of Germany published patent application DE-A 2,913,103, for example, discloses a liner for a flat cone shaped charge. This liner is made of an alloy which has a sufficiently high tantalum content to attain a density which is greater than that of copper. The alloy may contain further metals, such as tungsten, molybdenum or niobium. But then the required high ductility is no longer ensured.

Federal Republic of Germany published patent application DE-A 2,901,500 further discloses a liner material made of a superplastic alloy which is able to withstand great elongation without constriction until it breaks. The alloy is to be composed of lead and tin or zinc and aluminum.

Although these alloys have high ductility, they produce only an unsatisfactory power conversion in the target and a poor penetration depth in, for example, armor plates.

For liners made of iron materials, a technically pure low-carbon soft iron is generally employed which is available under the trade name Armco iron (American Rolling and Mining Company). The typical analysis of Armco iron reveals the following values, in percent by weight: 0.015% C, 0.02% Si, 0.002% Mn, 0.05% P; 0.022% S, 0.01% N; total impurities about 0.1%, and remainder Fe.

When refining raw iron, pure oxygen is added to the melt to convert the accompanying elements into slag. Oxygen then also goes in solution in the melt in the form of FeO. In this connection, an important dependency ratio applies, i.e., $C \times O = \text{constant}$. A steel having a low carbon (C) content therefore contains a relatively large amount of oxygen after refining so that, due to its hot shortness sensitivity, it must be deoxidized by the addition of ferromanganese. Since this is not possible with Armco iron, the melt is subjected to vacuum degasification which is intended to reduce the oxygen content and improve structural homogeneity.

Nevertheless, Armco iron does not satisfactorily meet the requirements placed on a liner material to cover explosive charges. In particular, it is not possible to produce liners with reproducibly uniform behavior from different charges of Armco iron melted at different times since various anisotropies, coarse grains and rolling textures occur occasionally due to the cold work. These anisotropies are evident already, for example, in that if a flat disc is the final shape for a flat cone liner or a spherical cap-shaped liner shell, uneven surface structures (orange skin and pull grooves) develop. If such liners are explosively reshaped into elongate projectiles, the shaping velocity is extremely high so that even the smallest inclusions have a significantly greater influence than in customary test shaping, and projectiles made of Armco iron often have an irregular, asymmetric appearance and form crooked projectiles which tend to tear off during projectile formation, thus resulting in unsatisfactory performance in the target.

SUMMARY OF THE INVENTION

It is an object of the present invention to provide a method of producing a low-carbon iron material to be used to produce a liner to cover an explosive charge so that it is possible, in a predetermined, reproducible manner, to produce liners which exhibit repeatable, completely isotropic behavior during explosive shaping.

The above object is initially achieved by a method of producing a low-carbon iron material for use in forming a liner to cover an explosive charge, comprising the following steps:

refining a molten raw iron material to produce an iron material with a dissolved carbon content of less than 0.01 weight % carbon (C);

casting the refined molten iron material in a deoxidized manner (killed by Al-powder) to provide a solidified iron casting; and reshaping the solidified iron casting at a temperature above 880° C. to set a desired structure of the reshaped casting in dependence on temperature and deformation with the grain size of the reshaped iron casting being set reproducibly to less than 100 μm.

According to preferred features of the method the grain size is set to between substantially 15 and 80 μm during the step of reshaping, the reshaping includes hot rolling the iron casting with a degree of reshaping $\phi$ (cross-sectional reduction ratio) of greater than 0.35, and/or the shaping temperature during the hot rolling is greater than 880° C., and preferably greater than 900° C.

The above object is further achieved by a low-carbon iron material for the production of a liner to cover an explosive charge produced according to the above method having an ultrafine grain structure with grain sizes of less than 100 μm, a dissolved carbon content of less than 0.01 weight % (C), and a reduction of area upon rupture which is greater than 80%. Preferably the iron material has a reduction of area upon rupture of between 85% and 92%, and a grain size of less than 50 μm.

With the present invention it is possible to produce, in a reproducible manner, an iron material for liners to cover explosive charges where the liners produced therefrom exhibit completely isotropic behavior. Tests in this connection with the object of optimizing explosion shaped projectiles have brought excellent results.

The resulting explosion shaped, very slender, rod-shaped projectiles 12 (see the FIG. 1) had a length of about 1 with reference to the caliber of the liner 10 from which they were produced, with fluctuations of less than 1%. All projectiles 12 without exception exhibited isotropic deformation without constrictions even at high elongation. The elongate projectiles 12, which exhibit high stability in flight and hit accuracy at distances of far more than 150 m, could be produced in a completely reproducible manner from liners 10 produced according to the invention.

DETAILED DESCRIPTION OF THE PREFERRED EMBODIMENT

Figure 1:
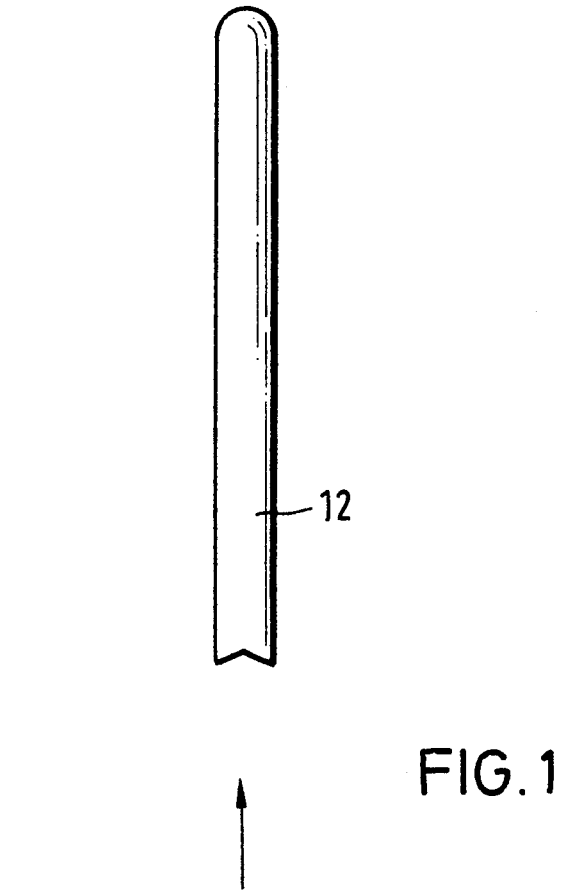
FIG. 1 is a schematic illustration of a charge liner of a low-carbon iron material according to the invention and the resulting projectile formed from the liner after explosion of the charge (not shown).

According to the method of the invention, molten raw iron material is initially refined, in a conventional manner, by the addition of oxygen to produce a molten iron material having a carbon content of less than 0.01 weight %. The refined molten iron material is then deoxidized with the measured addition of aluminum powder to the melt and cast. A typical compound of elements in weight % is as follows: 0.01% C, 0.02% Si, 0.13% Mn, 0.008% P, 0.011% S, 0.058% Al, 0.005% N, 0.00% Nb, 0.026% Ni, 0.00% Ti, 0.00% V, remainder Fe. The thus killed casting of the molten iron material produces a purely ferritic solidified iron material without any slag components or components of a second phase, but with microscopically finely dispersed aluminum nitrides (AlN). The highly decarbonized steel melt may possibly also be subjected to vacuum degasification.

Customarily today a charge of, e.g., about 60 to 100 tons of casting steel is cast in a continuous caster (here killed or deoxidized). Typically, the casting mold has a cross-sectional area of about 2 m×0.2 m. The solidified steel casting is cut to lengths of about 10 m and, if desired, is cooled.

To produce steel sheet from which the liners are made, the casting of the refined deoxidized steel is heated to the desired reshaping temperature. The cast iron material according to the invention is austenitized, i.e. the aluminum nitrides are dissolved and finely dispersed, in that the material is heat treated at about 1250° C., for example in a pusher type furnace, before it is hot rolled in a hot broadband rolling mill to set or produce a given, particularly a homogeneous, iron structure in dependence on temperature and deformation with grain sizes of less than 100 μm. The reshaping temperature during hot rolling must be greater than 880° C.

Preferably, reshaping should take place above 900° C., i.e. closely above the A3 or critical temperature line of the iron-carbon phase diagram in the range of the face-centered cubic gamma iron state (face-centered cubic lattice; γ-Fe; $A_3$ for extremely high purity iron=911° C.) since otherwise coarse grains would form due to recrystallization. However, hot rolling is also possible at temperatures up to 1200° C., since the coarse grain forming recrystallization in the iron material according to the present invention is additionally inhibited or prevented, respectively, by the finely dispersed Al nitrides. The rolling process is performed at the greatest possible degree or ratio of reshaping $\phi$ of more than 0.35, (i.e., 35% reduction in cross-section area) preferably at 0.45, so that a fine grained structure with grain sizes from approximately 15 to 80 μm, preferably between 20 and 30 μm, can be set with the lowest number of passes (through the rolling stands) by controlled final rolling. The resulting iron material (SSR) SSR=Spezial-Stahl Rheinmetall=Special Steel Rheinmetall according to the invention is distinguished by the very noticeable close proximity of a yield point of about 290 N/mm$^2$ and a tensile strength of about 300 N/mm$^2$. Moreover, the iron material formed according to the invention has a reduction in area upon rupture of greater than 80% and preferably between 85% and 92%.

Figure 2:
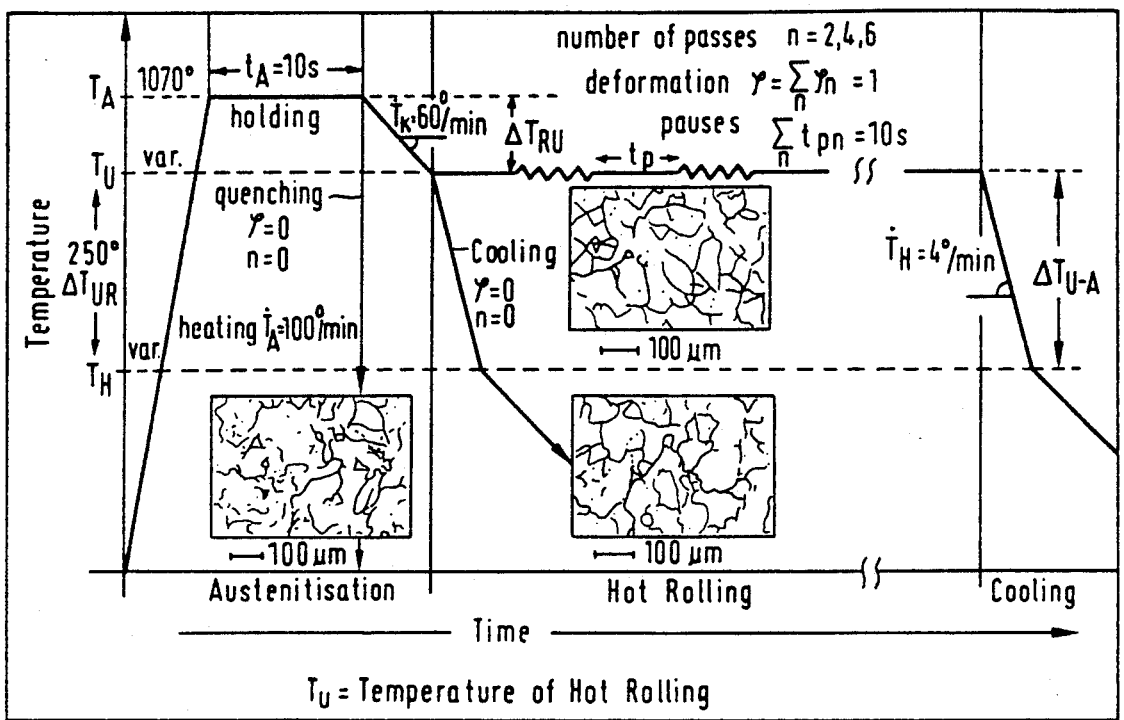
FIG. 2 is a time-temperature curve for the method according to the invention additionally showing the effects of the thermomechanical treatment according to the invention on the low-carbon steel.

Thereafter, the charge liners with the desired shapes, e.g., a liner 10 as shown in FIG. 1, are formed from the resulting sheets of hot rolled steel in a conventional manner. The effects of the thermomechanical treatment according to the invention on the microstructure of the SSR-Steel are shown in FIG. 2.

This hot broadband rolling process with the above-mentioned shaping parameters cannot be performed with Armco iron since any hot deformation, such as, for example, rolling, forging, bending or pressing, must not occur in a temperature range between 850° and 1050° C. due to the known danger of red shortness. Shaping must therefore take place only in the body-centered cubic state range of alpha iron (body-centered cubic lattice; α-Fe). Consequently it is not possible to positively set the grain size, but rather the latter is more or less accidental. A positively given reproducibility with homogeneous structure and isotropic shaping behavior does not exist. Due to textures and pull grooves in the structure, anisotropies occur in the shaping characteristics if shaping speeds are high.

In contrast thereto, the iron material according to the invention has an extremely high deep drawing quality and, due to its homogeneity, exhibits no preferred orientations whatsoever during shaping. It is therefore excellently suited for liners of all types (hollow pointed cone liners, flat cone liners, cup-shaped liners) which form projectiles or jets and also for cutting charges.

Because of its reproducibility, homogeneity and its isotropic deformation behavior with uniform tail formation of the rod-shaped projectile body without constrictions, the iron material (SSR) according to the invention is particularly well suited for explosion formed projectiles, with which a projectile length of greater than I with reference to the liner caliber can be realized without problems. No cracks, folds or asymmetries develop in connection with this iron material.

The present disclosure relates to the subject matter disclosed in Federal Republic of Germany patent Application P 38 09 051.1 of Mar. 18, 1988, the entire specification of which is incorporated herein by reference.

The invention now being fully described, it will be apparent to one of ordinary skill in the art that many changes and modifications can be made thereto without departing from the spirit or scope of the invention as set forth herein.

What is claimed:

1. A method of producing a low-carbon iron material for use in forming a liner to cover an explosive charge, comprising the following steps:

refining a molten raw iron material to produce a molten iron material with a dissolved carbon content of less than 0.01 weight % carbon (c);

deoxidizing the refined molten iron material;

casting the refined molten iron material to provide a solidified iron casting; and, reshaping the solidified iron casting at a temperature above 880° C. to set a desired structure of the reshaped casting in dependence on temperature and deformation with the grain size of the reshaped iron casting being set to between 20 and 100 μm.

2. A method as defined in claim 1 wherein the grain size is set to less than 50 μm during said step of reshaping.

3. A method as defined in claim 2 wherein the grain size is set to between substantially 20 and 30 μm during said step of reshaping.

4. A method as define din claim 1 wherein said step of reshaping includes hot rolling the iron casting with a cross-sectional reduction ratio $\phi$ of greater than 0.35.

5. A method as defined in claim 4 wherein said cross-sectional reduction ratio is approximately 0.45.

6. A method as defined in claim 4 wherein, in order to set the structure, said step of reshaping includes hot rolling the iron casting at a shaping temperature greater than 900° C.

7. A method as defined in claim 6 wherein: said step of deoxidizing casting includes adding aluminum powder to said molten iron material to deoxidize the iron material; and said shaping temperature is a temperature up to substantially 1200° C.

8. A method as defined in claim 4 wherein said solidified iron casting is cooled prior to said step of reshaping; and further comprising heat treating the cooled solidified iron casting prior to hot rolling to austenitize the iron material.

9. A method as defined in claim 8 wherein said step of heat treating is carried out at a temperature of approximately 1250° C.

10. A method as defined in claim 1 wherein said solidified iron casting is cooled prior to said step of reshaping; and further comprising heat treating the cooled solidified iron casting prior to said step of reshaping to austenitize the iron material.

11. A method as defined in claim 4 wherein said step of hot rolling includes rolling said iron casting into a steel sheet.

12. A method as defined in claim 1 wherein, in order to set the structure, said step of reshaping further includes hot rolling the iron casting.

13. A low-carbon iron material for the production of a liner to cover an explosive charge produced according to the method defined in claim 1 having:

an ultrafine grain structure with grain sizes of between 20 and 100 μm;

a dissolved carbon content of less than 0.01 weight % (C); and a reduction of area upon rupture which is greater than 80%.

14. A method of forming a liner to cover an explosive charge comprising providing a sheet of a low carbon iron material as define din claim 13, and using the sheet to form a liner for a projectile forming explosive charge.

15. An iron material as defined in claim 13 having a reduction of area upon rupture of between 85% and 92%.

16. An iron material as defined in claim 13 having a grain size of less than 50 μm.

17. In a method of producing a liner to cover an explosive charge including providing a low carbon iron material, and forming the liner for an explosive charge from the low carbon iron material; the improvement wherein said step of providing a low carbon iron material comprises the following steps:

refining a molten raw iron material to produce a molten iron material with a dissolved carbon content of less than 0.01 weight % carbon (c);

deoxidizing the refined molten iron material;

casting the deoxidized molten refined iron material to provide a solidified iron casting; and reshaping the solidified iron casting at a temperature above 880° C. to set a desire structure of the reshaped casting in dependence on temperature and deformation with the grain size of the reshaped iron casting being set to between 20 and 100 μm.

18. A low carbon iron material as defined in claim 13 having a yield point of approximately 290 $N/mm^2$ and a tensile strength of approximately 300 $N/mm^2$.

19. A method as defined in claim 8 wherein said step of deoxidizing includes adding aluminum powder to said molten iron material in an amount sufficient to deoxidize the iron material.

* * * * *